US006712630B1

(12) United States Patent
Davidov

(10) Patent No.: US 6,712,630 B1
(45) Date of Patent: Mar. 30, 2004

(54) PRESSURE ACTUATED ZERO INSERTION FORCE SOCKET

(75) Inventor: Vladimir Nikolayevich Davidov, St. Petersburg (RU)

(73) Assignee: Acuid Corporation Limited, Guernsey (GB)

( * ) Notice: Subject to any disclaimer, the term of this patent is extended or adjusted under 35 U.S.C. 154(b) by 0 days.

(21) Appl. No.: 09/582,733

(22) PCT Filed: Apr. 20, 2000

(86) PCT No.: PCT/RU00/00149

§ 371 (c)(1),
(2), (4) Date: Jun. 27, 2000

(87) PCT Pub. No.: WO01/82416

PCT Pub. Date: Nov. 1, 2001

(51) Int. Cl.[7] ..... H01R 13/15; H01R 13/62
(52) U.S. Cl. ..... 439/260; 439/67; 439/632
(58) Field of Search ..... 439/260, 67, 259, 439/59, 630, 629, 632

(56) References Cited

U.S. PATENT DOCUMENTS 3,795,888 A 3/1974 Nardo et al. ..... 439/630
4,911,643 A * 3/1990 Perry et al. ..... 439/67
4,968,265 A * 11/1990 Fox, Jr. ..... 439/197
5,071,357 A 12/1991 Van Brunt, Jr. et al. ..... 439/67
5,222,668 A 6/1993 Frankeny et al. ..... 439/197
5,316,486 A * 5/1994 Tanaka et al. ..... 439/62
5,813,876 A 9/1998 Rutigliano ..... 439/260

* cited by examiner

*Primary Examiner*—Javaid H. Nasri
(74) *Attorney, Agent, or Firm*—Darby & Darby

(57) ABSTRACT

An electrical connector for establishing an interconnection between the contact pads of a printed circuit board device under test (DUT) and an electrical device. The connector includes a flexible circuit carrying the interconnect between the DUT and pcb, which is moved into position by the inflation of a bladder that changes its form to press the contacts on the flexible circuit onto the contact positions of the DUT. The bladder is constrained to minimize its expansion. The flexible circuit is not constrained except at the point it is mated with the circuit board of the equipment driving the DUT. The path of the flexible circuit is shaped by fixed formers and terminates at the bladder. This avoids impinging on the DUT area outwith the contact zone. The connector includes variants which have a lock to secure the DUT in place and sensors to determine when the DUT is fully inserted.

10 Claims, 5 Drawing Sheets

PRESSURE ACTUATED ZERO INSERTION FORCE SOCKET

FIELD OF THE INVENTION

The present invention relates to electrical connectors and more particularly to air or fluid pressure actuated connectors for electrically connecting printed circuit boards or electrical parts.

BACKGROUND OF THE INVENTION

During the post-manufacture of semiconductor devices and printed circuit boards, the components (whether they be individual integrated circuit devices or circuit boards containing integrated circuit devices) are subjected to test prior to their shipment. Electrical connectors for interconnecting components and circuit boards to testers and drivers are widely available. Typically, such connectors possess contacting elements that extend from the connector to effect contact with respective contact pads (e.g., gold plated pads) located on an external surface of the DUT. Contact is usually achieved through the use of some compression or clamping means that engages the contact elements with their respective contact pads. Zero insertion force (ZIF) card edge connectors are used to overcome those problems associated with high insertion forces, for example, see U.S. Pat. No. 3,795,888.

One type of zero insertion force connector utilizes fluid pressure to actuate an expandable bladder located within a housing of the connector to exert a force against a flexible circuit, see U.S. Pat. No. 5,071,357.

Some of this type of connector use a flexible circuit board which has, for example, both ends fixed, such as in U.S. Pat. No. 5,222,668, or, one end secured and free end fixed rotatable about moving fulcrum, such as in U.S. Pat. No. 5,813,876.

Although the use of pressure actuated zero insertion force connectors are known in the art, there are several problems that have yet to be overcome by current zero insertion force connector designs.

Thus, in the known art, there requires to be substantial structures extending beyond the contacts of the flexible circuit and these interfere with components or structures on the DUT. U.S. Pat. No. 5,813,876 is typical of this type of problem.

Another problem of connectors in the known art is the poor path control for the connector material, with deleterious effects on signal integrity, particularly crosstalk and impedance control.

Another problem common to connectors in the known art is that DUT may be damaged and have metal or fiberglass fragments protruding from its surface. In existing connectors this can severely damage the contact.

A further problem of existing connectors is that most have a large scrubbing distance. The life of the socket is directly proportional to the scrubbing distance, so the socket will have a shorter life than in a design with a very low scrubbing distance such as the present invention.

Also, in both cases, with fixed end and pivoting end connectors, significant pressure shall be applied to the flexible circuit to effect the connection, otherwise relatively thin circuits with high flexibility shall be used. However, to connect high speed devices, for example, DDR memory modules, 5 layer circuit is typically necessary. This means that the flexible circuit may require substantial force to deform that is close to its breaking point.

A final and critical problem of sockets with expanding bladders such as in U.S. Pat. No. 5,813,876, is that the expandable area is not fully constrained, allowing the bladder to expand to a size where the wall thickness is reduced to beyond its limit of elasticity. Where the wall is reduced to less than 50% of its static thickness, bladder failure can ensue.

The present invention overcomes or at least alleviates the problems mentioned above.

SUMMARY OF THE INVENTION

The present invention is an electrical connector for establishing an electrical connection between a printed circuit board device under test (DUT) and an electrical device, such as driving the DUT.

The connector includes a flexible circuit that is capable of both mating to a tester, or driver, and connecting electrically to the DUT.

The flexible circuit has a first surface and an opposite second surface and includes at least one metal layer and a plurality of electrically conductive contacts that are attached to the metal layer along the first surface. The flexible circuit has a portion secured to the contacts of the tester and opposite free second portion or portions that is used to make electrical contact to the DUT contact pads. A resilient bladder is positioned adjacent the free edge of the flexible circuit on its second surface opposite to first surface where contacts to the DUT are located and is capable of exerting a force against this first surface of the flexible circuit to cause the contacts on its second surface to physically engage contact pads of the printed circuit board under test. The flexible circuit is shaped by means of one or more formers. Once inserted, the DUT is secured by a lock so as to prevent voluntary removal and damage of the DUT.

A gas cylinder, pump, air compressor or other fluid pressure source is operatively coupled to the bladder for causing the bladder to exert a uniform force to the contacts of the flexible circuit to engage with the contact pads of the printed circuit board.

A piston and a buffer material, or a spring may provide an action equivalent to the bladder.

BRIEF DESCRIPTION OF THE DRAWINGS

The present invention is illustrated by way of example and is not limited by the figures of the accompanying drawings, in which like references indicate similar elements, and in which.

DETAILED DESCRIPTION OF THE INVENTION

An apparatus and method that provides an electrical connection between a test apparatus, or other electrical device, and the contact pads of a printed circuit board is described. In the following description, a detailed explanation of the patent's features will be used to aid understanding, and numerous specific details are set forth such as material types, dimensions, processing steps, etc., in order to provide a thorough understanding of the present invention. However, it will be obvious to one skilled in the art that the invention may be practiced without or with a wide variety of modifications of specific details. In other instances, well known elements and processing techniques have not been shown in particular detail in order to avoid unnecessarily obscuring the present invention. A double sided connector is described, where contact is made to both sides of the DUT simultaneously, however it is obvious that a single sided embodiment of the invention can be implemented simply by the omission of one set of items.

Figure 1:
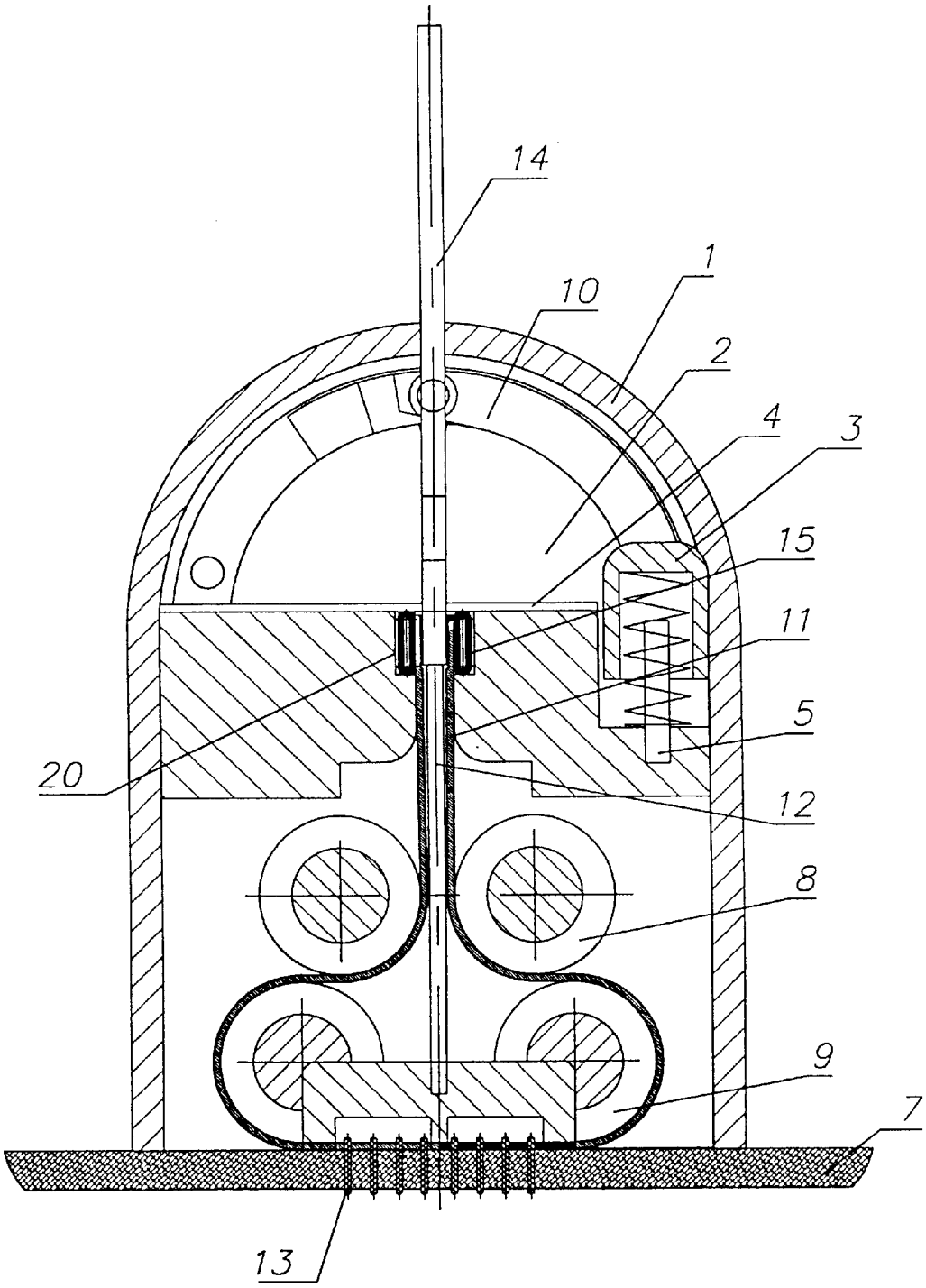
FIG. 1 illustrates a cross section of an electrical connector/socket of one embodiment of the present invention in an engaged position.

FIG. 1 illustrates an electrical connector/socket of one embodiment of the present invention in an engaged state. The connector is used to electrically couple a DUT in the form of a series of semiconductor elements on printed circuit board 14 with another electrical device 7 such as another circuit board. Electrical device 7 may be a tester, driver, communication equipment, etc. The interconnect in the connector is carried on flexible circuit 11 comprising at least one metal layer, terminating in contact pads 16 illustrated in the zoomed region of FIG. 1 shown in FIG. 2. Flexible circuit 11 is coupled to electrical device 7 at one portion and is shaped within the connector housing around formers 8 and 9. Each free end of flexible circuit 11 forms a side wall for each of two chambers 20 each chamber 20 housing a resilient bladder 15.

The path of flexible circuit 11 is determined by formers 8, 9 and 12. Former element 12 provides the necessary angle of inclination to flexible circuit 11 such that it clears the DUT contact area when disengaged and may also include an additional angled component. Formers may be fixed, rotatable or free. The former 12 acts also as a hard stop for the DUT 14 and additionally includes projections mating with key recesses on the circuit board so as to prevent incorrect insertion of the DUT or insertion of the DUT having characteristics, e.g. circuit type or voltage, which differ from those the socket is designed for.

In the present embodiment, a single flexible circuit 11 is shaped as shown in FIG. 1 and electrically connected to circuit board 7 by means of pins 13. Alternatively, the connector may comprise two flexible circuit elements shaped in a simpler form by one pair of cylinder formers pressing the circuits to the surface of board 7 such that each circuit forms a hyperbola-like structure. Other form are possible.

Figure 2:
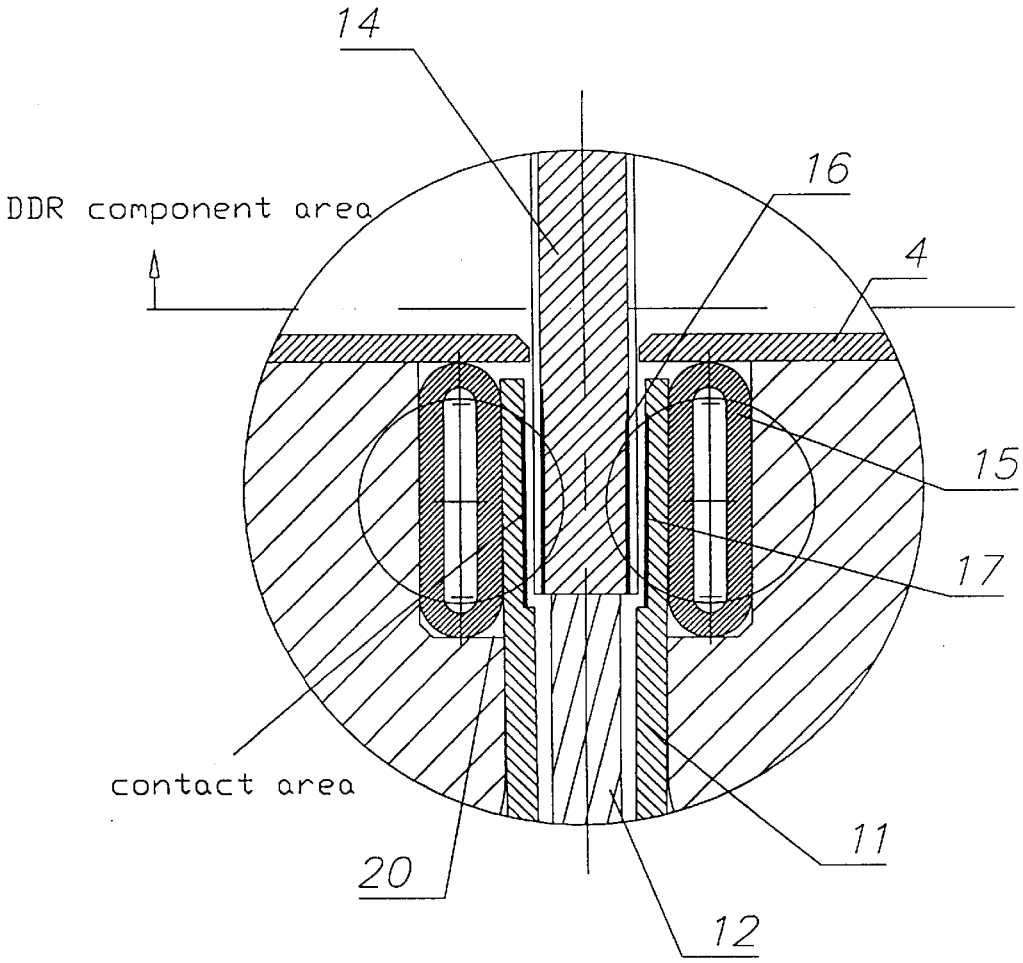
FIG. 2 shows an exploded view of a cross section of FIG. 1 illustrating in more details the contact area of the socket.

Bladder 15 in FIG. 1 is constrained by the structure of the connector as best shown in FIG. 2, such that the circumference of chamber 20 enclosing the bladder is much less than the critical external perimeter of the bladder. In the example embodiment, the bladder is a highly elastic resilient tube circular in section, constrained to form an oval track by bladder chamber 20 on one side and by the flexible circuit on the other side. Where there are gaps that would enable the bladder to expand to some extent, these must be limited such that if the bladder is pressurized then it cannot expand such that the wall of the bladder is reduced by more than 50% in thickness, or, such that the gap width is less than the double wall thickness to avoid the bladder run-out from the chamber under pressure. Cover plate 4 is used to cap bladder chamber 20 which may be of variable section and variable volume, and also serve to protect flexible circuit 11 from stray material on the DUT or from rough DUT handling by an operator.

Figure 3:
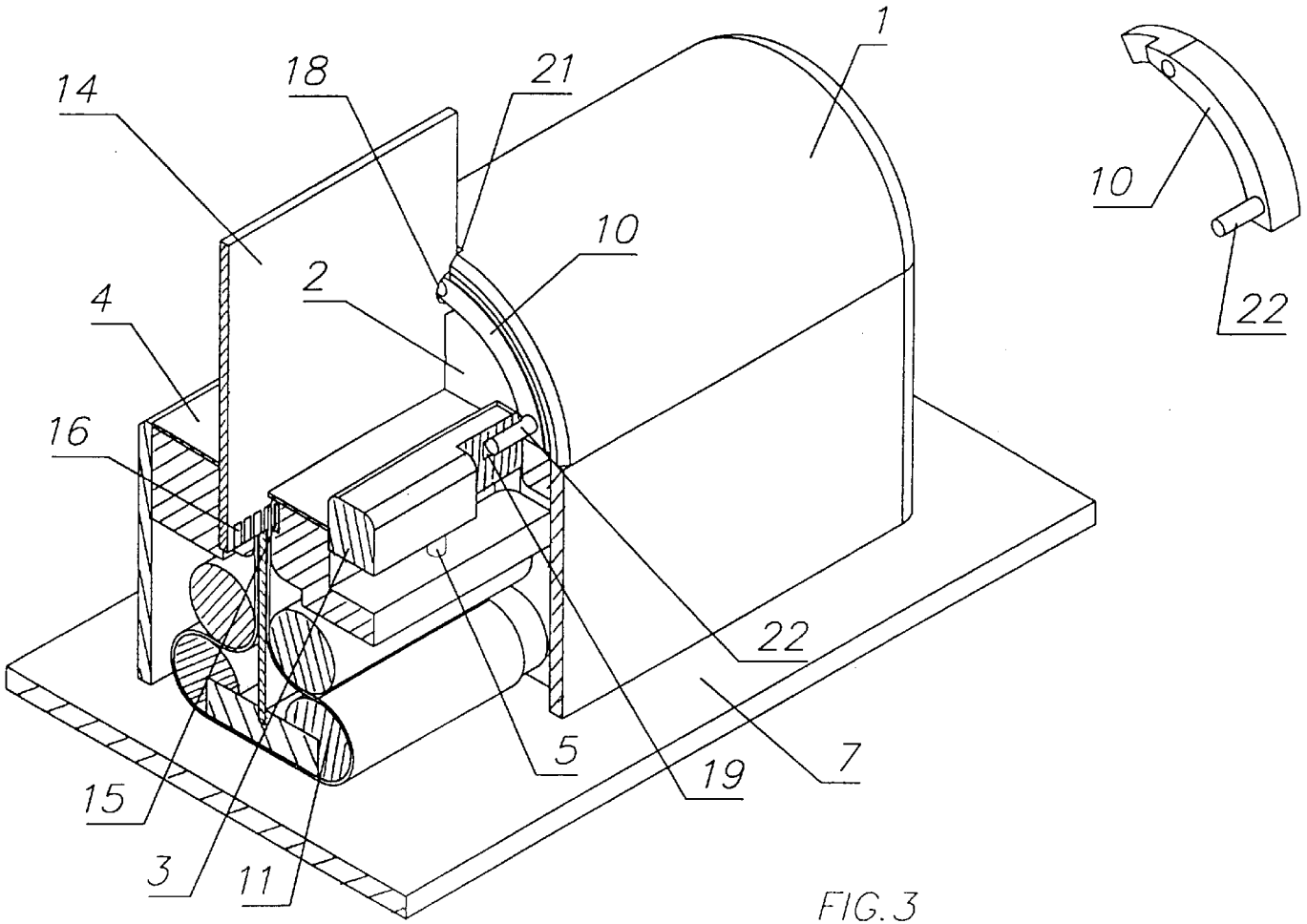
FIG. 3 illustrates a perspective cut-away view of another embodiment of the invention having a locking element for securing a printed circuit board.

As best shown in partial cut-away view in FIG. 3, the connector includes a support frame/housing 1 with opening 21 that accommodates the insertion of DUT 14, or a similar device, into the housing. It is important that the bladder is not inflated when there is no DUT in the socket so the embodiment includes a locking system and a sensor to detect the DUT. A preferred sensor arrangement is to detect the load of the DUT on former 12, which also acts as a stop, such that when a sensor at each of former/stop 12 detects pressure from a DUT, then and only then can the bladder be inflated. Alternatively, the sensor system may be arranged to detect locking cam 10 in a position that locks the DUT after it is fully inserted in the socket. Both sensors may be used simultaneously to ensure the proper operation of the connector.

The embodiment illustrated in FIG. 3 shows the socket of the present invention in a position where the DUT is fully inserted and locked in and button 3 is released. Button 3 is arranged movably on sprig 5 provided with a spring member (as best shown in FIG. 1) and has slot 19 for housing pin 22 protruding from one side of locking cam 10. In the present embodiment, locking cam 10 is made in the form of sector gate arranged movable along guiding bracket 2 of housing 1. The movement of pin 22 within slot 19 (also shown in FIG. 4) extending horizontally within button 3 enables locking cam 10 to move along the guiding bracket 2. The leftmost position of pin 22 within said slot corresponds to the locked state of locking cam 10, while the rightmost position of pin 22 within said slot corresponds to the opened state of locking cam 10.

The location of locking cam 10 coincides with a physical feature on the DUT for example, a key recess 18, such that when the DUT is fully in position, button 3 can be released and the cam moves back to prevent the DUT being removed. An optical or Hall effect sensor detects whether there is DUT 14 in DUT guide opening 21 and another optical sensor detects whether cam 10 is in a closed position. These sensors control a small electrical system to prevent the bladder being inflated without the DUT fully in position. The sensor for the cam position can be simply a magnet and reed relay combination.

Figure 5:
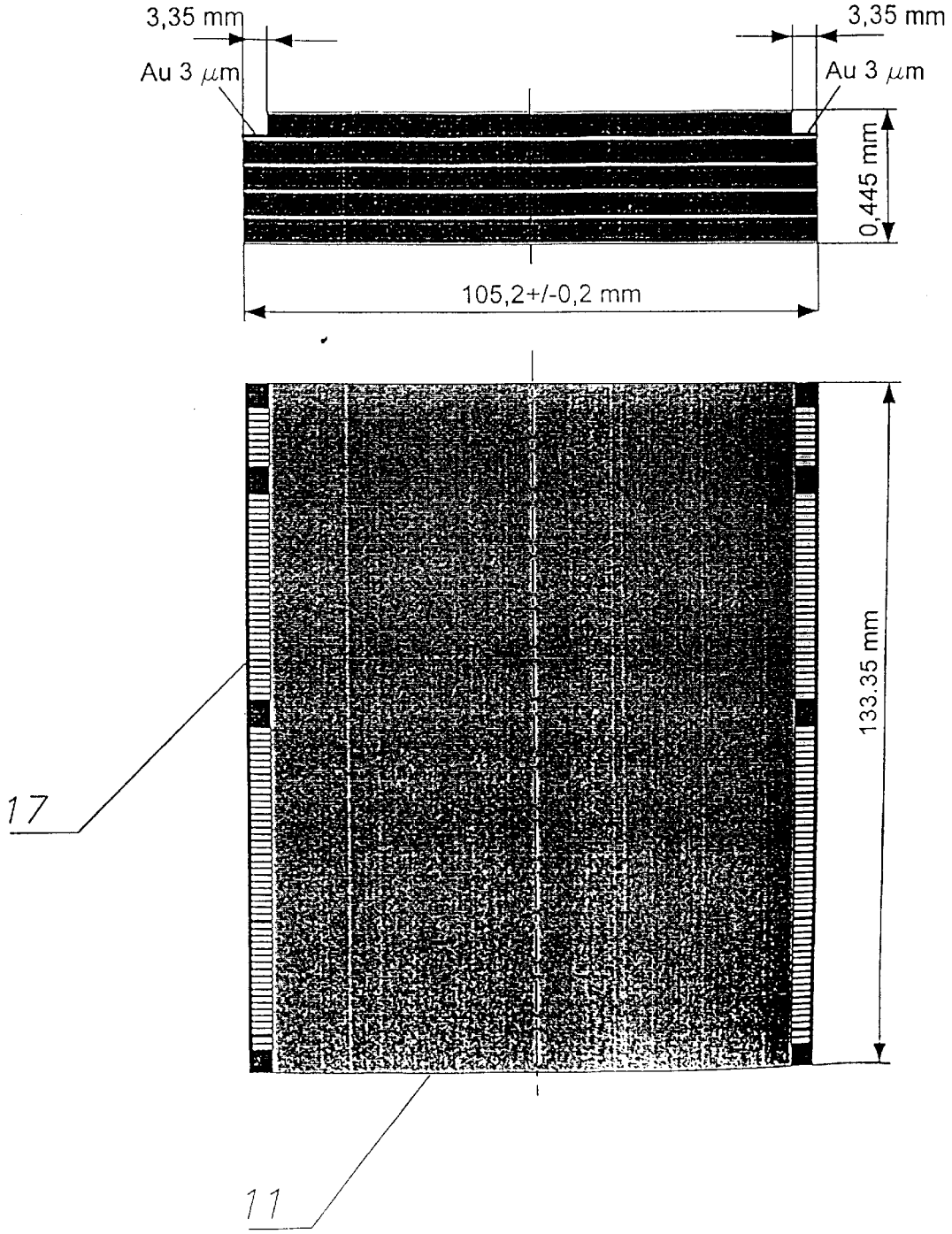
FIG. 5 shows an example of the flexible circuit used in the electrical connector according to one embodiment of the present invention.

Flexible circuit 11 in FIG. 1 has contacts that match in position those of the DUT. Normally, there is a plurality of contacts, for example 184 contacts for a memory module, and these contacts may use any of the contact technologies that are widely available. Typically the contacts are formed by plating nickel and then gold onto the copper of flexible circuit 11 as shown in FIG. 5. For greater wear, contacts may be welded, sweated, soldered or otherwise joined to the flexible circuit. In another embodiment, a thin conductive elastomer may be fixed to flexible circuit 11 to form contacts that are easily replaced. The contact pads generally possess a rectangular configuration with a width and length of about 1 mm and 2 mm, respectively. Center-to-center spacing is about 1.3 mm. The contact pads may be substantially larger or smaller dimensions depending upon the particular application.

The resilient bladder, as used in one embodiment of the invention, comprises a polyurethane or silicone rubber material and possesses a sidewall thickness of 0.24 mm, a diameter of 3 mm and a length similar to the DUT—typically of 133 mm for a memory module, or may be lesser, e.g. 127 mm, or longer depending on particular embodiment. Under vacuum the thickness is 0.5 mm. Round tubing is the simplest form for the bladder, but it may be preformed into the oval structure or into another suitable shape. The operating pressure of the bladder is typically 6 bar. Other tubing types may be used as a very wide range of possible thicknesses, diameters and operating pressures may be required for different connector arrangements, providing they comply with the conditions for the control of bladder wall thickness mentioned above. The tube bladder design given as an example has a life of many millions of operations depending on the tube material.

The fluid pressure source may include an air compressor, pump, pressurized gas cylinder, or a liquid. Tubing 15 may include silicone rubber, Teflon or any other material suitable for transporting pressurized gas, pneumatic or hydraulic fluids.

Figure 4:
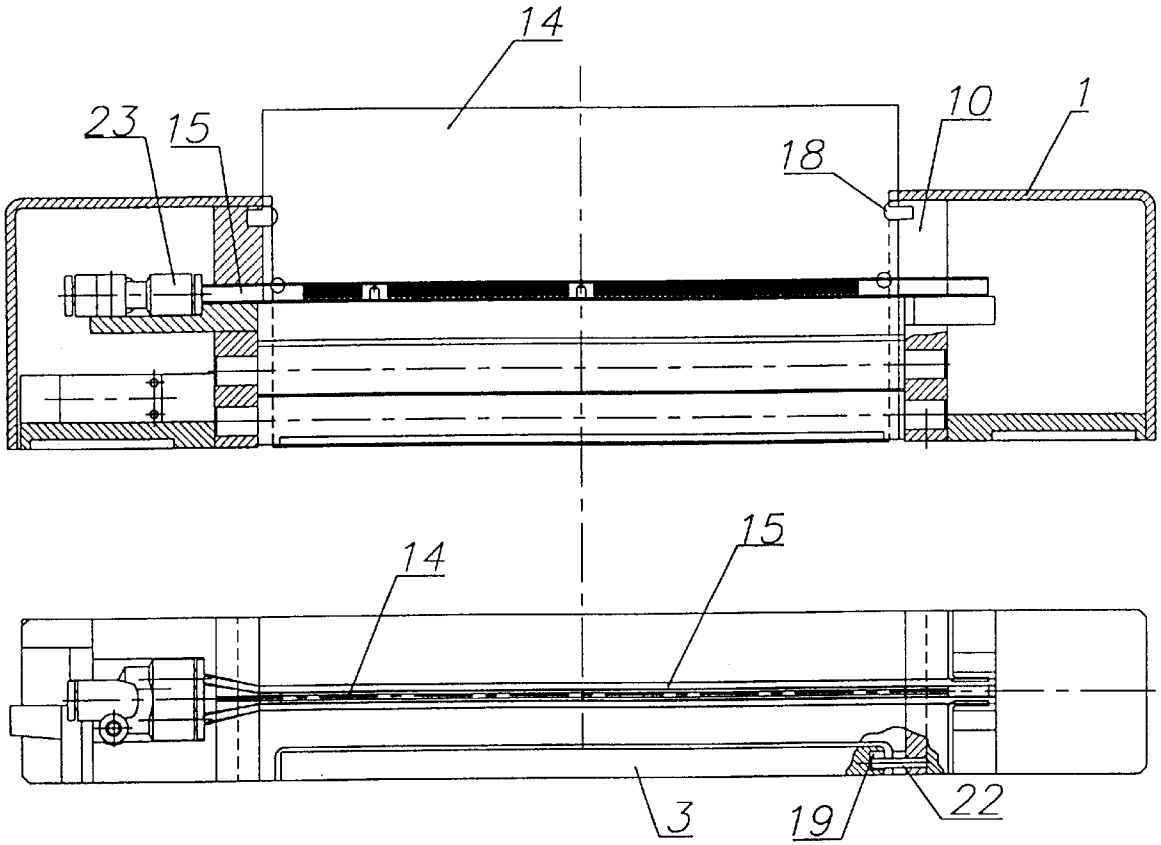
FIG. 4 illustrates a side view of the electrical connector according to the invention.

FIG. 4 shows pneumatic drive 23 at one end of the bladder, it can be also arranged at each end of the bladder, but this is not essential. In another embodiment of the present invention, the bladder may be coupled to a vacuum pump. Pursuant to this embodiment, a vacuum may be drawn on the bladder to cause the bladder to contract to effect a complete disengagement of the flexible circuit contact elements from the DUT contact pads before the circuit board is withdrawn from the connector or the bladder may be in the engaged state all the time and simply disengaged by vacuum. In order to ensure a complete withdrawal of contact elements from contact pads the flexible circuit may be secured to the bladder by applying an adhesive to the backside of the flexible circuit at points, or along a line, opposite contact elements.

A key feature of the connector is its ability due to the arrangement of the formers to allow very stiff flexible circuit boards required for accurate processing of high speed memory devices.

Flexible circuit 11, as shown in FIG. 5, is generally formed by laminating a polyimide substrate with a copper foil having a thickness of approximately 0.001 to 0.002 inches. It is appreciated that the conductive circuitry may also include printed circuitry similar to that used in printed circuit boards. The copper foil is typically laminated onto the polyimide substrate using an epoxy-based adhesive. A photolithographic technique is used to create the specific circuit pattern. Any of another of dielectric films or tapes may be used in the fabrication of the flexible circuit. Moreover, it is appreciated that the flexible circuit is not limited to a copper foil and laminate type of construction. For example, flexible circuit 11 may comprise a plurality of spaced-apart copper wires that are affixed to a flexible dielectric substrate. Contact elements 17 are attached or formed onto conductive circuitry, and are used to effect an electrical connection between the circuitry and contact pads 16 of PCB 14.

The flexible circuit 11 manufactured from a material such as Kapton or polyimide will likely have many layers. With reference to FIG. 5, a plan view and side view of flexible circuit 11 of one embodiment of the present invention are shown. The example flexible circuit shown in FIG. 5 is used to connect to DDR memory modules, wherein each signal line has a grounded screen, therefore, for the connector comprising two signal lines for each pad the flexible circuit typically includes five layers: two signal 50 ohm layers and three screen layers. In another embodiment, the flexible link of the RIMM connector includes three layers: one signal 28 ohm layer and two screen layers.

The typical characteristics of flexible circuits for testing DDR and RIMM memory modules using the present invention are listed below:

| Properties | Circuit for DDR module | Circuit for RIMM module |
|---|---|---|
| Impedance | 50 ohms | 28 ohms |
| Pad pitch | 1 mm | 0.8 mm |
| Pad | 168 | 184 |
| Pad width | 0.7 mm | 0.5 mm |
| Layers | 5 | 3 |
| Copper layer thickness | 9 $\mu$m | 18 $\mu$m |
| Track width | 76 $\mu$m | 234 $\mu$m |
| Flexible link thickness | 445 $\mu$m | 254 $\mu$m |
| Thickness with rigid part | 1.445 mm | 1.254 mm |
| Overall dimension | 133 × 105.2 mm | 127 × 90.92 mm |
| Layer composition | 1. 9 mm copper<br>2. 25 mm adhesive layer<br>3. 50 mm Kapton<br>4. 25 mm adhesive layer<br>5. 9 mm copper<br>6. 25 mm adhesive layer<br>7. 50 mm Kapton<br>8. 25 mm adhesive layer<br>9. 9 mm copper<br>10. 25 mm adhesive layer<br>11. 50 mm Kapton<br>12. 25 mm adhesive layer<br>13. 9 mm copper<br>14. 25 mm adhesive layer<br>15. 50 mm Kapton<br>16. 25 mm adhesive layer<br>17. 9 mm copper | 1. 18 mm copper<br>2. 25 mm adhesive layer<br>3. 50 mm Kapton<br>4. 25 mm adhesive layer<br>5. 18 mm copper<br>6. 25 mm adhesive layer<br>7. 50 mm Kapton<br>8. 25 mm adhesive layer<br>9. 18 mm copper |

These flexible circuits have elastic properties not dissimilar from spring steel of the same thickness due to the number of layers, the amount of copper needed to screen the interconnect and the material thickness needed to achieve the correct impedance without the trace widths becoming impractically thin. The ability to use these flexible boards is unique to the present invention.

Prior art such as U.S. Pat. No. 5,813,876 shows flexible boards under the action of an expanding bag which can function with thin flexible circuits but not with the thick circuits needed for routing very high speed signals. The present invention maintains a simple transmission line from the fixed connection where the flexible circuit mates with the driving equipment to the contact point where it mates with the DUT. The whole path is tightly controlled and there are no free elements such as the interconnect between the connector and driving equipment in U.S. Pat. No. 5,813,876.

DUT stop 12 in FIG. 1 of the present invention can be of a material with a very low magnetic permeability to avoid totally affecting the signals in the flexible circuit. This means that the change in path of the flexible circuit under any condition is extremely small. Differences of hundreds of picoseconds are easily created by movements of only a few mm in connectors of the prior art, whereas the specification for example for a RIMM connector is less than +/−50 ps and this can only be achieved by methods such as embodied in the current invention for strict path control for the flexible circuit.

This means that flexible circuit 14 may require substantial force to deform, so that the prior art connectors do not provide forces that are required to effect connection using multilayer flexible circuits having thickness more than 0.1–0.2 mm.

At the same time, the present invention allows to reduce significantly the force applied to the flexible circuit thanks to the use of the specific arrangement as described including the lever motion. As is well known, the longer is the lever arm, the lesser can be the force applied to obtain the same contact pressure.

The maximum thickness of the flexible circuit according to the present invention is limited by the following equation for the deflection force per mm of pad length:

$$f_d=3DE_{Cu}b_{Cu}^3h/12L^3+3DE_{PCB}b_{PCB}^3h/12L^3,$$

where $D$—deflection, $E$—stiffness, $b$—circuit thickness, $h$—average pad length, $L$—flexible circuit length $$E_{Cu}=1.17\times10^6\ \text{kgf/cm}^2;\ E_{PCB}=0.0816\times10^6\ \text{kgf/cm}^2$$

$$b_{Cu}=0.0045\ \text{cm for five 9 microns Cu layers};\ b_{PCB}=\sim0.045\ \text{cm}.$$

$$\text{As } E_{Cu}b_{Cu}^3<<E_{PCB}b_{PCB}^3\ f_d\cong3DE_{PCB}b_{PCB}^3h/12L^3$$

$$f_d\cong3\times0.045\times0.0816\times10^6\times0.05^3\times0.05/12\times1^3<6\ \text{g}$$

This means that the force of less than 6 g is required to deflect the $10\times0.45\times0.5\ \text{mm}^3$ flexible circuit according to the present invention.

In one example of the invention, housing 1 possesses an overall height and side width of about 35 mm, respectively, and an overall length of about 180 mm.

The operation of the connector will be described with reference to FIG. 1 and FIG. 3.

The operator depresses button 3 causing pin 22 to move in slot 19 to its rightmost position which moves cam 10 clockwise along guide 2 to free DUT opening 18. The DUT 14 is inserted into the test position and button 3 is released by the operator thereby the spring member 5 moves button 3 up which displaces pin 22 to its leftmost position and returns cam 10 in a counterclockwise movement so as to lock the DUT in the testing position.

The DUT being fully inserted is detected by sensors, for example optocouplers or pressure sensors. The control system connected to the sensors cause the bladder to be inflated, which causes the force to be exerted on the wall of the bladder to change the shape of bladder 15 in FIG. 2. The bladder tries to take a circular cross section but is constrained by the chamber. The expression of the forces in the bladder cause the flat wall of the oval bladder shape to distend to form a more circular profile, causing the bladder to press strongly on the free portion of flexible circuit 11 as shown in FIG. 2. This causes the contacts 17 of the flexible circuit to align with and mate with contacts 16 of the DUT. The test equipment carries out its test function on the DUT via the connector. At the end of test, the pressure is removed or replaced with a vacuum. This causes the bladder to return to its rest position and the contacts to free the DUT. The operator then presses button 3 in FIG. 3 to release the DUT. Alternatively, the bladder may be forced both by the fluid pressure source and the cover plate which is made in this case movable.

In an automated environment button 3 is not required, but a system of sensors may still be used to ensure the DUT is in position before tests start. In most embodiments the vacuum valve and the atmospheric valve are the same, and simply equalize the bladder pressure with atmospheric.

Thus, an apparatus that provides an electrical connection between a test apparatus, or other electrical device, and the contact pads of a printed circuit board is described. Many alternations and modifications to the present invention will no doubt become apparent to the person skilled in the art after having read the foregoing description, and it is to be understood that the particular embodiments shown and described by way of illustration are in no way intended to be limiting while the relative dimensions, geometric shapes, materials and process parameters set forth within the specification are exemplary of the disclosed embodiments only.

What is claimed is:

1. An electrical connector for connecting a circuit board having a plurality of electrical contacts to another electrical device, said connector comprising:

a flexible circuit having a first portion to be attached and electrically mating to said electrical device and at least one free second portion having contacts to make electrical contact to said circuit board;

a former shaping said flexible circuit to form a transfer element mating the surface of said electrical device with the surface of said circuit board, a force generator applying a force to said at least one free second portion of said flexible circuit to electrically engage said contacts of said flexible circuit with said contacts of said circuit board, wherein said flexible circuit is arranged within the connector to form a zero insertion slot for said circuit board until said force generator is energized, said free portion of said flexible circuit being movable to electrically engage contacts of said circuit board when the force generator is energized;

wherein said flexible circuit extends substantially only over the portion of said circuit board in which said contacts are located;

wherein said flexible circuit forms a lever having a free end on which said second portion of said flexible circuit is located;

wherein said second portion of said flexible circuit is located such as to substantially reduce the force required to effect the physical engagement of said contacts;

wherein said force generator comprises a resilient bladder coupled to a fluid pressure and confined by a chamber, so that the fluid pressure means acting on said bladder cause the bladder to exert a force as a result of the bladder changing its cross section shape rather than primarily by expansion;

means for drawing a vacuum on said bladder to cause said bladder to contract to effect a full disengagement of said flexible circuit contacts and said circuit board contacts;

wherein said bladder is constrained by the free portion of the flexible circuit having sufficient stiffness and arranged so as to effect a full disengagement of the circuit board and flexible circuit when said force generator is de-energized;

wherein said bladder is constrained in a chamber of variable section;

wherein the chamber constrains the bladders expansion such that the wall thickness of the bladder cannot reduce by more than 50%.

2. A connector according to claim 1 wherein the chamber constrains the bladder's expansion such that a gap width is less than the double wall thickness of the bladder.

3. An electrical connector for connecting a circuit board having a plurality of electrical contacts to another electrical device, said connector comprising:

a flexible circuit having a first portion to be attached and electrically mating to said electrical device and at least one free second portion having contacts to make electrical contact to said circuit board;

a former shaping said flexible circuit to form a transfer element mating the surface of said electrical device with the surface of said circuit board, a force generator applying a force to said at least one free second portion of said flexible circuit to electrically engage said contacts of said flexible circuit with said contacts of said circuit board, wherein said flexible circuit is arranged within the connector to form a zero insertion slot for said circuit board until said force generator is energized, said free portion of said flexible circuit being movable to electrically engage contacts of said circuit board when the force generator is energized;

wherein said flexible circuit extends substantially only over the portion of said circuit board in which said contacts are located;

wherein said flexible circuit forms a lever having a free end on which said second portion of said flexible circuit is located;

wherein said second portion of said flexible is located such as to substantially reduce the force required to effect the physical engagement of said contacts;

further comprising an optical or pressure sensor to detect the proper insertion of the DUT into the connector.

4. A connector according to claim 3 further comprising a shield to prevent damage to the flexible circuit by the insertion of foreign material instead of the DUT or the insertion of damaged DUTs.

5. A connector according to claim 4 wherein the flexible circuit has a plurality of layers to control the signal integrity such as in impedance and cross talk.

6. A connector according to claim 5 further comprising a locking means which prevents taking the circuit board out of the connector when said means for applying a force is energized.

7. A connector according to claim 3 further comprising a shield to prevent damage to the flexible circuit by the insertion of foreign material instead of the DUT or the insertion of damaged DUTs.

8. An electrical connector for connecting a circuit board having a plurality of electrical contacts to another electrical device, said connector comprising:

a flexible circuit having a first portion to be attached and electrically mating to said electrical device and at least one free second portion having contacts to make electrical contact to said circuit board;

a former shaping said flexible circuit to form a transfer element mating the surface of said electrical device with the surface of said circuit board, a force generator applying a force to said at least one free second portion of said flexible circuit to electrically engage said contacts of said flexible circuit with said contacts of said circuit board, wherein said flexible circuit is arranged within the connector to form a zero insertion slot for said circuit board until said force generator is energized, said free portion of said flexible circuit being movable to electrically engage contacts of said circuit board when the force generator is energized;

wherein said force generator comprises a resilient bladder coupled to a fluid pressure and confined by a chamber, so that the fluid pressure means acting on said bladder cause the bladder to exert a force as a result of the bladder changing its cross section shape rather than primarily by expansion;

wherein said bladder is constrained in a chamber of variable section; and wherein the chamber constrains the bladder's expansion such that the wall thickness of the bladder cannot reduce by more than 50%.

9. An electrical connector for connecting a circuit board having a plurality of electrical contacts to another electrical device, said connector comprising:

a flexible circuit having a first portion to be attached and electrically mating to said electrical device and at least one free second portion having contacts to make electrical contact to said circuit board;

a former shaping said flexible circuit to form a transfer element mating the surface of said electrical device with the surface of said circuit board, a force generator applying a force to said at least one free second portion of said flexible circuit to electrically engage said contacts of said flexible circuit with said contacts of said circuit board, wherein said flexible circuit is arranged within the connector to form a zero insertion slot for said circuit board until said force generator is energized, said free portion of said flexible circuit being movable to electrically engage contacts of said circuit board when the force generator is energized;

wherein said force generator comprises a resilient bladder coupled to a fluid pressure and confined by a chamber, so that the fluid pressure means acting on said bladder cause the bladder to exert a force as a result of the bladder changing its cross section shape rather than primarily by expansion;

wherein said bladder is constrained in a chamber of variable section; and wherein the chamber constrains the bladder's expansion such that a gap width is less than the double wall thickness of the bladder.

10. An electrical connector for connecting a circuit board having a plurality of electrical contacts to another electrical device, said connector comprising:

a flexible circuit having a first portion to be attached and electrically mating to said electrical device and at least one free second portion having contacts to make electrical contact to said circuit board;

a former shaping said flexible circuit to form a transfer element mating the surface of said electrical device with the surface of said circuit board, a force generator applying a force to said at least one free second portion of said flexible circuit to electrically engage said contacts of said flexible circuit with said contacts of said circuit board, wherein said flexible circuit is arranged within the connector to form a zero insertion slot for said circuit board until said force generator is energized, said free portion of said flexible circuit being movable to electrically engage contacts of said circuit board when the force generator is energized; and further comprising an optical or pressure sensor to detect the proper insertion of the DUT into the connector.

* * * * *